US009368921B2

(12) United States Patent
Gomez et al.

(10) Patent No.: US 9,368,921 B2
(45) Date of Patent: Jun. 14, 2016

(54) INTERCONNECT ASSEMBLY

(71) Applicant: Hewlett-Packard Development Company, L.P., Houston, TX (US)

(72) Inventors: Adolfo Adolfo Gomez, Fort Collins, CO (US); Tom J. Searby, Eaton, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/630,178

(22) Filed: Feb. 24, 2015

(65) Prior Publication Data

US 2015/0171565 A1 Jun. 18, 2015

Related U.S. Application Data

(63) Continuation of application No. 13/752,606, filed on Jan. 29, 2013, now Pat. No. 8,998,636.

(51) Int. Cl.

| | |
|---|---|
| ***H01R 11/00*** | (2006.01) |
| ***H01R 13/66*** | (2006.01) |
| ***H01R 27/02*** | (2006.01) |
| ***H01R 31/06*** | (2006.01) |

(52) U.S. Cl.

CPC ..... *H01R 13/665* (2013.01); *H01R 27/02* (2013.01); *H01R 31/065* (2013.01)

(58) Field of Classification Search

CPC .... H01R 13/665; H01R 31/065; H01R 27/02; G06F 13/385; G06F 1/266; G06T 5/003

USPC ..... 439/505

See application file for complete search history.

(56) References Cited

U.S. PATENT DOCUMENTS

| | | | | |
|---|---|---|---|---|
| 5,923,531 | A * | 7/1999 | Bachman | H05K 7/20718 165/80.3 |
| 5,937,950 | A | 8/1999 | Adams et al. | |
| 6,184,682 | B1 * | 2/2001 | Ehman | G06T 5/003 324/300 |
| 6,628,517 | B1 | 9/2003 | Helot et al. | |
| 6,955,292 | B2 * | 10/2005 | Nakamura | G06K 7/0047 235/375 |
| 7,270,578 | B2 | 9/2007 | Hunag | |
| 7,275,935 | B2 | 10/2007 | Chen et al. | |
| 7,419,388 | B2 | 9/2008 | Rubin et al. | |
| 7,462,073 | B2 | 12/2008 | Bell et al. | |
| 7,508,678 | B2 | 3/2009 | Chen | |

(Continued)

OTHER PUBLICATIONS

ICY DOCK 2009. EZ Convert Pro MB982SPR-2S Full Metal Dual 2.5" to 3.5" SATA HDD/SSD Raid Converter.

(Continued)

*Primary Examiner* — Jean F Duverne

(74) *Attorney, Agent, or Firm* — HP Inc. Patent Department

(57) ABSTRACT

An interconnect assembly includes a housing, multiple signal connectors provided on the housing, a power bus having one or more bus elements, and a combination connector. The multiple signal connectors include a first signal connector and a second signal connector, and each signal connector includes a plurality of signal elements. The combination connector is provided on the housing and includes a plurality of connection elements, including a first set of connection elements which route within the housing to the plurality of signal elements of the first signal connector, a second set of connection elements which route within the housing to the plurality of signal elements of the second signal connector, and a third set of connection elements which route within the housing to the one or more bus elements of the power bus.

19 Claims, 13 Drawing Sheets

(56) References Cited

U.S. PATENT DOCUMENTS

| | | | | |
|---|---|---|---|---|
| 7,527,521 | B2 | 5/2009 | Rubin et al. | |
| 7,537,485 | B2 | 5/2009 | Bell et al. | |
| 7,611,367 | B2 | 11/2009 | Lee | |
| 7,648,379 | B2 | 1/2010 | Johnson et al. | |
| 7,803,013 | B2 | 9/2010 | Haggay et al. | |
| 7,895,464 | B2 | 2/2011 | Lynn | |
| 8,083,540 | B1 | 12/2011 | Spicer et al. | |
| 2003/0065733 | A1* | 4/2003 | Pecone | G06F 13/385 709/211 |
| 2003/0222503 | A1* | 12/2003 | Lam | G06F 1/266 307/38 |
| 2005/0060467 | A1 | 3/2005 | Wieck | |
| 2011/0069441 | A1 | 3/2011 | Killen et al. | |

OTHER PUBLICATIONS

Mason, et al. SAS Standards and Technology Update. Storage Developer Conference. Santa Clara, 2011.

StarTech.com. 1985-2013. 2.5in SATA/SAS SSD/HDD to 3.5in SATA Hard Driver Converter.

* cited by examiner

INTERCONNECT ASSEMBLY

CROSS-REFERENCE TO RELATED APPLICATIONS

This application is a Continuation of U.S. patent application Ser. No. 13/752,606, filed Jan. 29, 2013, entitled "Interconnect Assembly", which is incorporated herein by reference in its entirety.

BACKGROUND

Consumers appreciate ease of use in their devices. They also appreciate the ability to update their devices with new features and/or functionality. Designers and manufacturers may, therefore, endeavor to create or build devices directed toward one or more of these objectives.

BRIEF DESCRIPTION OF THE DRAWINGS

The following detailed description references the drawings, wherein.

DETAILED DESCRIPTION

Computing devices, such as workstations and servers, need to record and retrieve information and data. The quantity of such data and information can often be quite large. Therefore, the ability to enable higher storage device density for such computing devices is desirable. Providing configuration flexibility to achieve such higher storage device density is also desirable.

Redundancy may be important in some computing device applications where high reliability transfers with low data loss is needed. For example, the ability to provide redundant SAS capability for single storage device configurations in certain server-based environments may be desirable.

Figure 1:
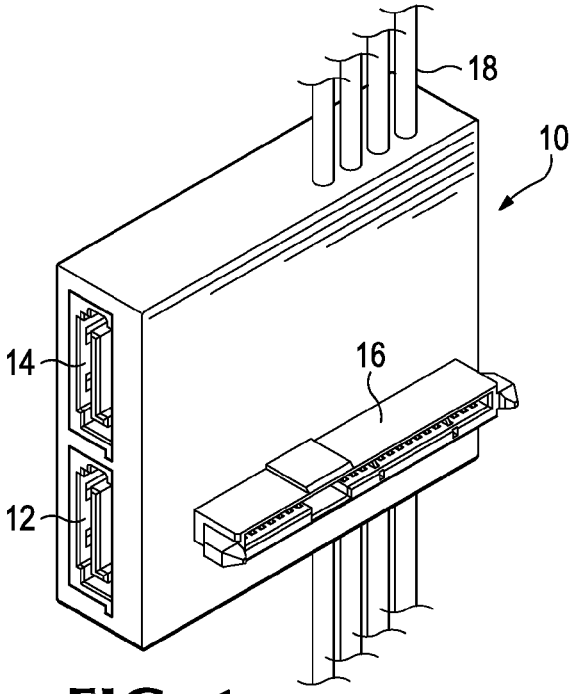
FIG. 1 is a perspective view of an example of an interconnect assembly.

An example of an interconnect assembly 10 directed to addressing these challenges is illustrated in FIG. 1. As used herein, the terms "Serial ATA", "Serial AT Attachment", and "SATA" are defined as including a computer bus interface and associated hardware and software for connecting host bus adapters to storage devices. The Serial ATA compatibility specification originates from The Serial ATA International Organization ("SATA-IO). As used herein, the terms "Serial Attached SCSI" and "SAS" are defined as including a point-to-point serial protocol, as well as associated hardware and software, that is used to move data to and from storage devices. The T10 technical committee of the International Committee for Information Technology Standards ("INCITS") currently develops and maintains the SAS protocol.

As used herein, the term "combination connector" is defined as including, but not necessarily being limited to, a connector that provides multiple sets of signals and power. An example includes an SFF-8482 style connector that includes fifteen (15) power pins and two sets of SAS signals (seven (7) pins each) for connection to SAS devices, such as storage devices. Additional examples include an SFF-8639 style connector, an SFF-8680 style connector and/or other custom connector. In at least some other examples, the combination connector may also be compatible with SATA and/or other types of devices.

As used herein, "backplane" is defined as including, but not necessarily being limited to, a printed circuit board (PCB) assembly that splits or routes signals and power from a combination connector to a plurality of individual storage device connectors. As used herein, "storage device" is defined as including, but not necessarily being limited to a device for recording data and information for subsequent retrieval. Examples of storage devices include, but are not limited to, hard disks, optical drives, tape drives, rotating platters, non-volatile semiconductor memories, solid state memories, magnetic bubble memories, floating-gate transistor memories, memristor assemblies, etc. These storage devices may use a variety of types of storage protocols including, without limitation, SAS, SATA, Peripheral Component Interconnect express ("PCIe"), etc.

As used herein, "host controller" is defined as including, but not necessarily being limited to, a device used to transceive (i.e., transmit and receive) data and information signals to and from storage devices. As used herein, "cable assembly" is defined as including, but not necessarily being limited to, a plurality of wires or cables that: (i) transceive signals, (ii) are bound together by sleeves, insulation, conduit, tape, straps, ties, etc., and (iii) terminate on one or both ends by plugs, connectors, sockets, terminals, and/or pins. As used herein, "power bus" and "power cables" are defined as including, but not necessarily being limited to, an assembly or arrangement that supplies power to one or more combination connectors either through a backplane or by direct connection to such combination connector.

Referring again to FIG. 1, interconnect assembly 10 includes a first signal connector 12 and a second signal connector 14. Interconnect assembly 10 additionally includes a combination connector 16 coupled to first signal connector 12 and second signal connector 14. Interconnect assembly 10 further includes a power bus or plurality of power cables 18 coupled to combination connector 16 to supply power to combination connector 16.

In the example of interconnect assembly 10 shown in FIG. 1, first signal connector 12 includes a Serial AT Attachment (SATA) connector. It is to be understood, however, that in other examples of interconnect assembly 10, first signal connector 12 may be a different type of connector. Also, in the example of interconnect assembly 10 shown in FIG. 1, second signal connector 14 includes a Serial AT Attachment (SATA) connector. It is to also be understood, however, that in other examples of interconnect assembly 10, second signal connector 14 may be a different type of connector.

Additionally, in the example of interconnect assembly 10 shown in FIG. 1, combination connector 16 includes a Serial Attached SCSI (SAS) connector. It is to be additionally understood, however, that in other examples of interconnect assembly 10, combination connector 16 may be a different type of connector.

Figure 2:
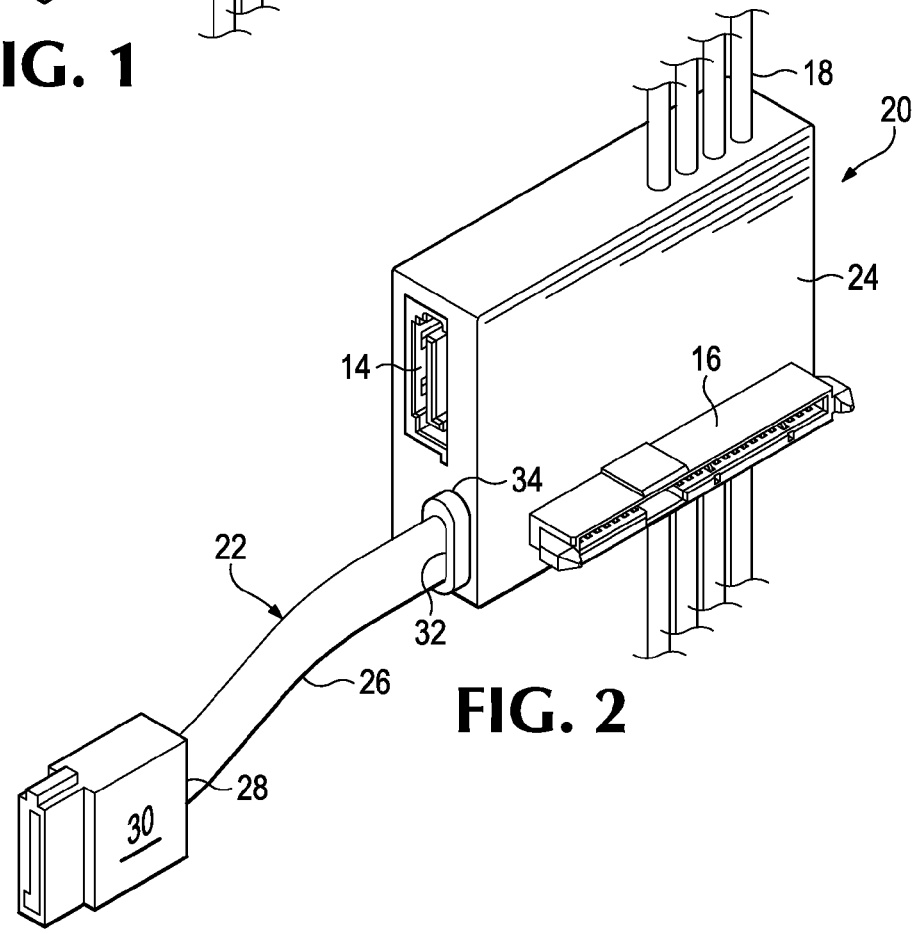
FIG. 2 is a perspective view of another example of an interconnect assembly.

Another example of an interconnect assembly 20 is shown in FIG. 2. As can be seen in FIG. 2, interconnect assembly 20 includes a first cable assembly 22 and a second signal connector 14. As can be seen in FIG. 2, first cable assembly 22 includes a flexible sleeve 26 that terminates on one end 28 in a plug 30. The other end 32 of first cable assembly 22 is coupled to housing 24. As can also be seen in FIG. 2, first cable assembly 22 includes a strain relief 34 coupled to housing 24.

In the example of interconnect assembly 20 shown in FIG. 2, plug 30 includes a Serial AT Attachment (SATA) connector. It is to also be understood, however, that in other examples of interconnect assembly 20, plug 30 may be a different type of connector.

Interconnect assembly 20 additionally includes combination connector 16 coupled to first cable assembly 22 and to second signal connector 14. Interconnect assembly 20 further includes a power bus or plurality of power cables 18 coupled to combination connector 16 to supply power to combination connector 16.

Figure 3:
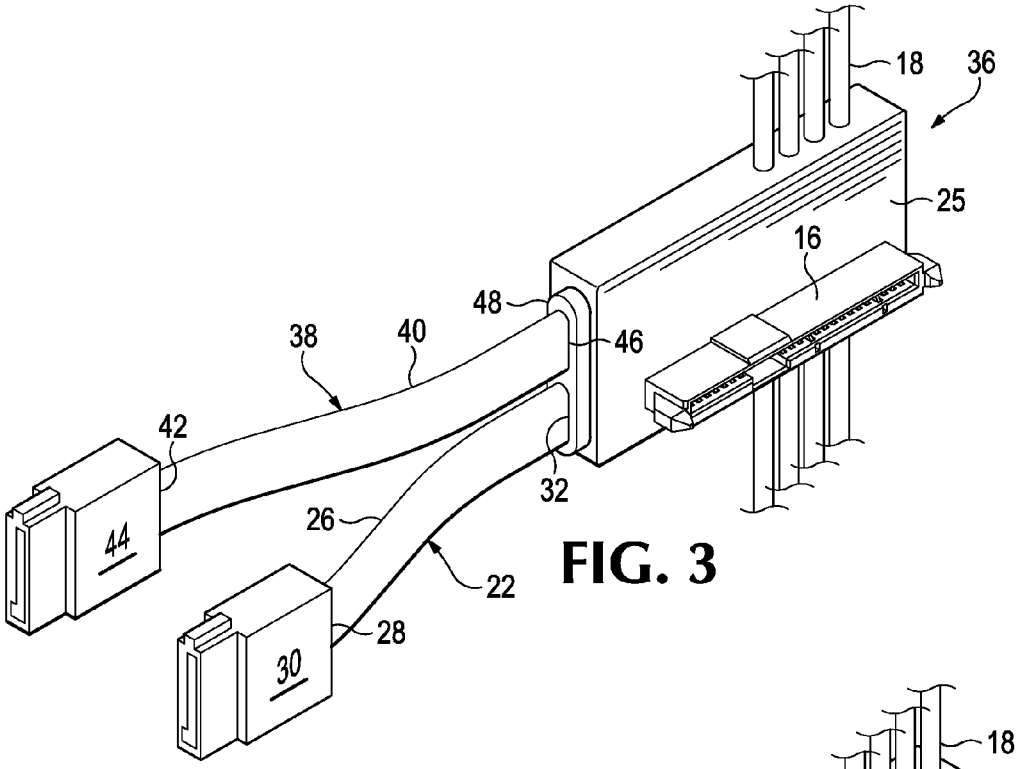
FIG. 3 is a perspective view of an additional example of an interconnect assembly.

An additional example of an interconnect assembly 36 is shown in FIG. 3. As can be seen in FIG. 3, interconnect assembly 36 includes a second cable assembly 38 and first cable assembly 22. As can be seen in FIG. 3, second cable assembly 38 includes a flexible sleeve 40 that terminates on one end 42 in a plug 44. The other end 46 of second cable assembly 38 is coupled to housing 25. As can also be seen in FIG. 3, respective first and second cable assemblies 22 and 38 include a strain relief 48 coupled to housing 25.

In the example of interconnect assembly 36 shown in FIG. 3, plug 44 includes a Serial AT Attachment (SATA) connector. It is to also be understood, however, that in other examples of interconnect assembly 20, plug 44 may be a different type of connector.

Interconnect assembly 36 additionally includes combination connector 16 coupled to first cable assembly 22 and second cable assembly 38. Interconnect assembly 36 further includes power bus or plurality of power cables 18 coupled to combination connector 16 to supply power to combination connector 16.

Figure 4:
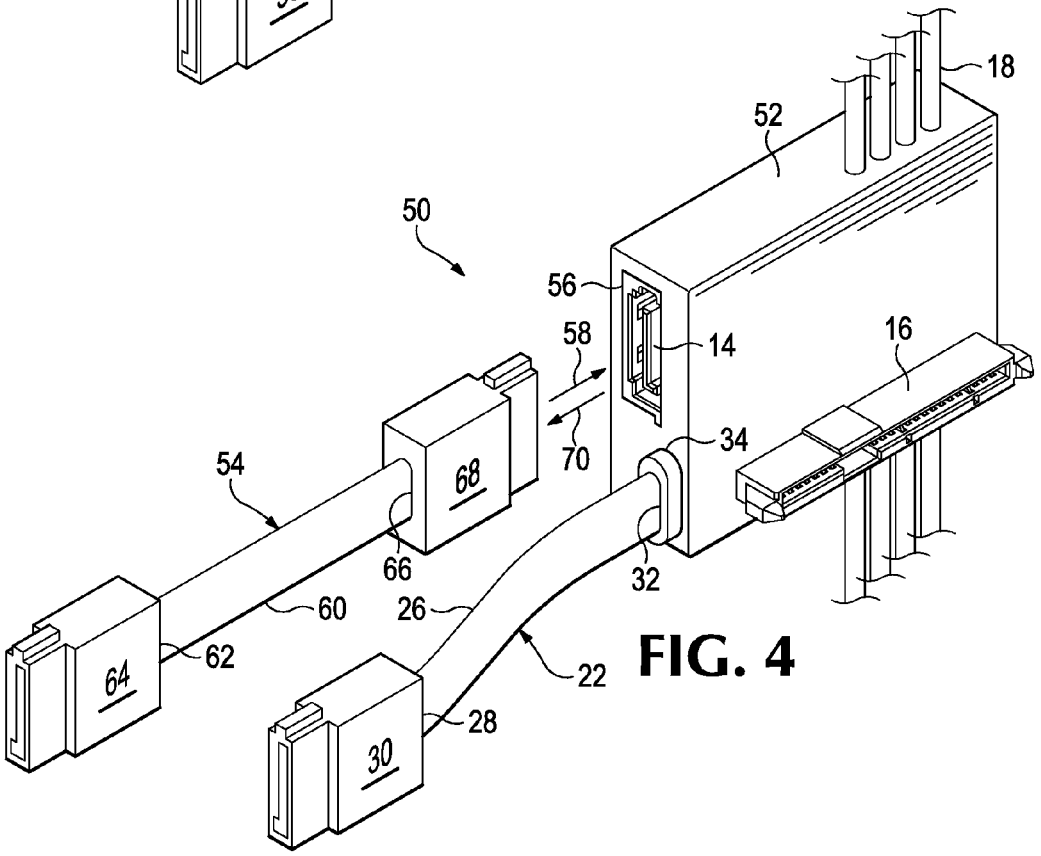
FIG. 4 is a perspective view of a further example of an interconnect assembly.

A further example of an interconnect assembly 50 is shown in FIG. 4. As can be seen in FIG. 4, interconnect assembly 50 includes the above-described first cable assembly 22 and second cable assembly 54 couplable to second signal connector 14 by inserting it into socket 56 defined by housing 52 in the direction indicated by arrow 58. As can be seen in FIG. 4, second cable assembly 54 includes a flexible sleeve 60 that terminates on one end 62 in a plug 64 and on another end 66 in a plug 68. Plug 68 is designed to matingly engage with second signal connector 14 to couple second cable assembly 54 to second signal connector 14. Second cable assembly 54 may be uncoupled from second signal connector 14 by removing plug 68 from socket 56 in the direction indicated by arrow 70.

In the example of interconnect assembly 50 shown in FIG. 4, plugs 64 and 68 include Serial AT Attachment (SATA) connectors. It is to also be understood, however, that in other examples of interconnect assembly 50, both or either of plugs 64 and/or 68 may be a different type of connector.

Interconnect assembly 50 additionally includes combination connector 16 coupled to first cable assembly 22 and to second signal connector 14. Interconnect assembly 50 further includes power bus or plurality of power cables 18 coupled to combination connector 16 to supply power to combination connector 16.

Figure 5:
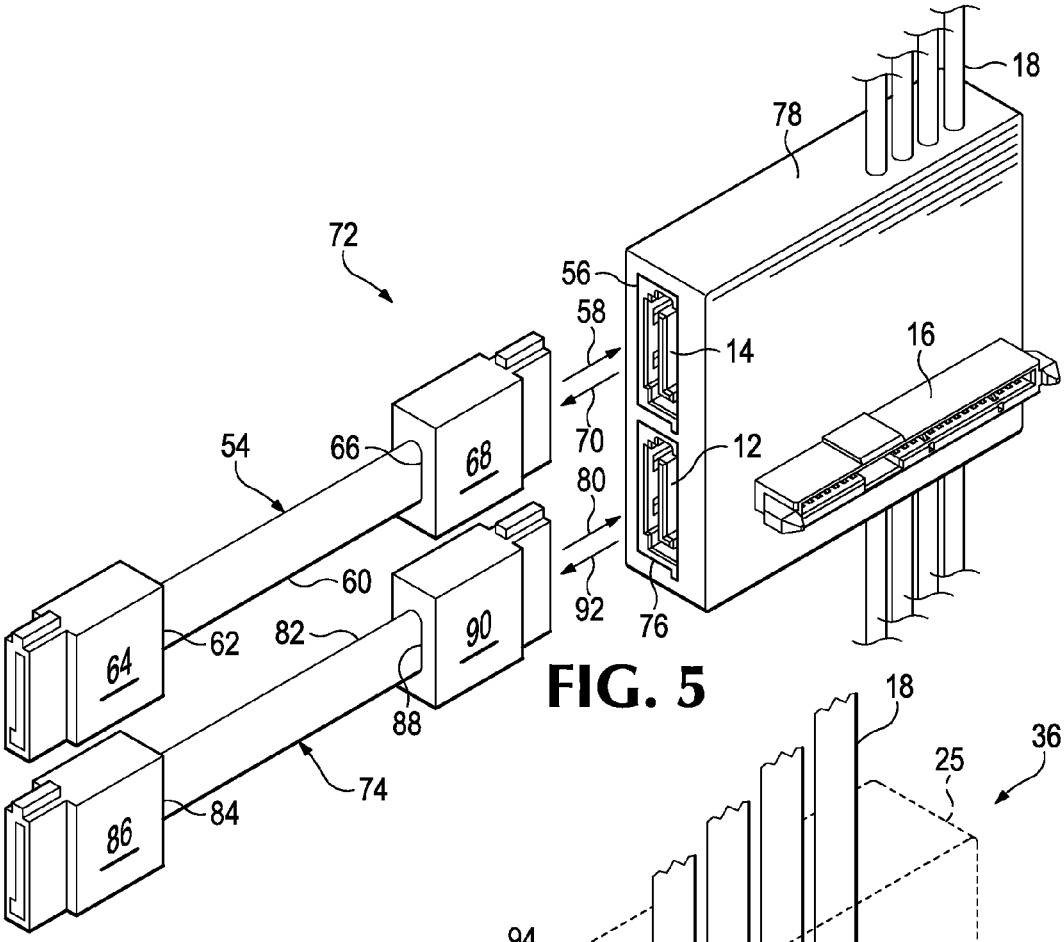
FIG. 5 is a perspective view of yet a further example of an interconnect assembly.

Yet a further example of an interconnect assembly 72 is shown in FIG. 5. As can be seen in FIG. 5, interconnect assembly 72 includes the above-described second cable assembly 54 as well as a first cable assembly 74 couplable to first signal connector 12 by inserting it into socket 76 defined by housing 78 in the direction indicated by arrow 80. First cable assembly 74 includes a flexible sleeve 82 that terminates on one end 84 in a plug 86 and on another end 88 in a plug 90. Plug 90 is designed to matingly engage with first signal connector 12 to couple first cable assembly 74 to first signal connector 12. First cable assembly 74 may be uncoupled from first signal connector 12 by removing plug 90 from socket 76 in the direction indicated by arrow 92.

In the example of interconnect assembly 72 shown in FIG. 5, plugs 86 and 90 include Serial AT Attachment (SATA) connectors. It is to also be understood, however, that in other examples of interconnect assembly 72, both or either of plugs 86 and/or 90 may be a different type of connector.

Interconnect assembly 72 additionally includes combination connector 16 coupled to first signal connector 12 and to second signal connector 14. Interconnect assembly 72 further includes power bus or plurality of power cables 18 coupled to combination connector 16 to supply power to combination connector 16.

Figure 6:
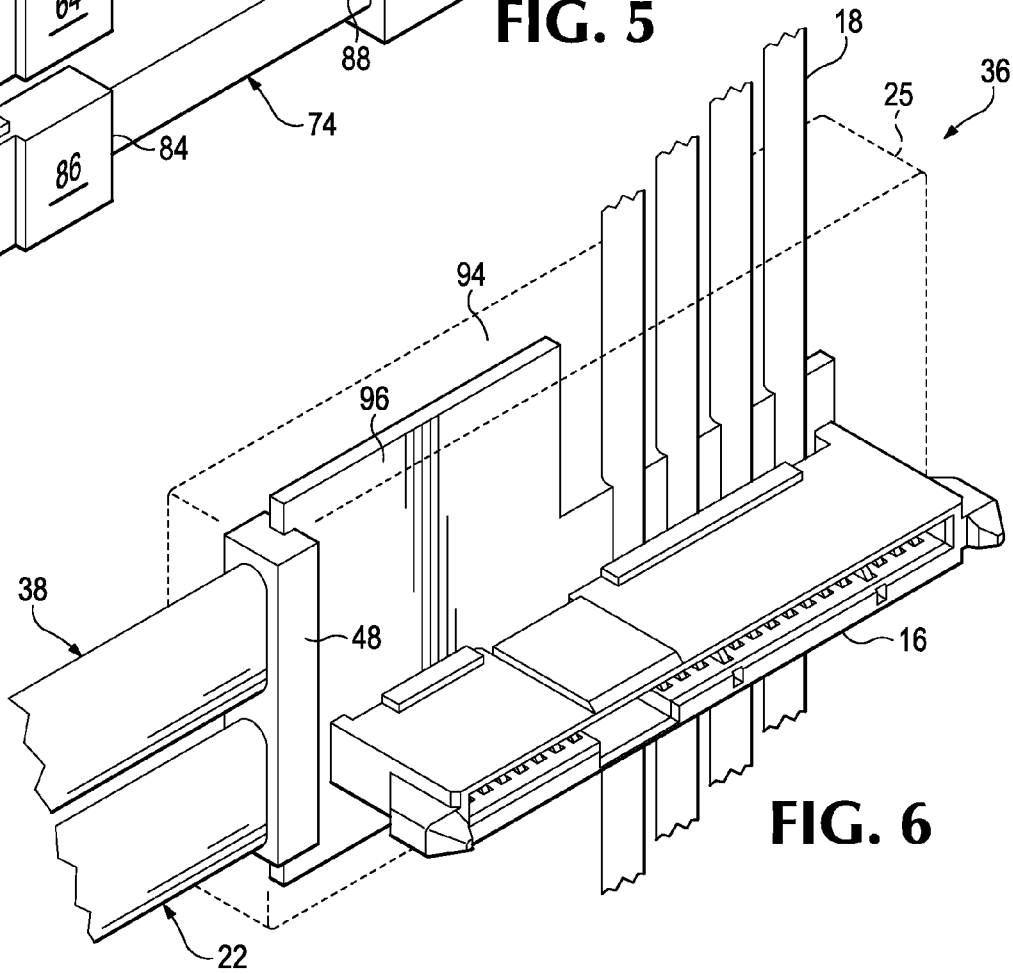
FIG. 6 is an enlarged perspective view of an interior of a housing of the interconnect assembly of FIG. 3.

An enlarged perspective view of an interior 94 of housing 25 of interconnect assembly 36 is shown in FIG. 6. As can be seen in FIG. 6, interconnect assembly 36 includes a printed circuit board (PCB) 96 disposed in interior 94 of housing 25 to which combination connector 16 is connected. Power bus or power cables 18 may be soldered to printed circuit board (PCB) 96 if PCB 96 includes traces to combination connector 16 or, alternatively, power bus or power cables 18 may be directly coupled to combination connector 16 by soldering.

Although not shown, it is to be understood that examples of interconnect assemblies 10, 20, 50, and 72 may also include printed circuit boards similar or identical to printed circuit board 96 to which first and second signal connectors 12 and 14, as well as strain relief 34 are connected, as applicable. It is also to be understood that other examples of one or more of interconnect assemblies, such as interconnect assemblies 10, 20, 36, 50, and 72, may include a different number of cables or wires for power bus or power cables 18.

Figure 7:
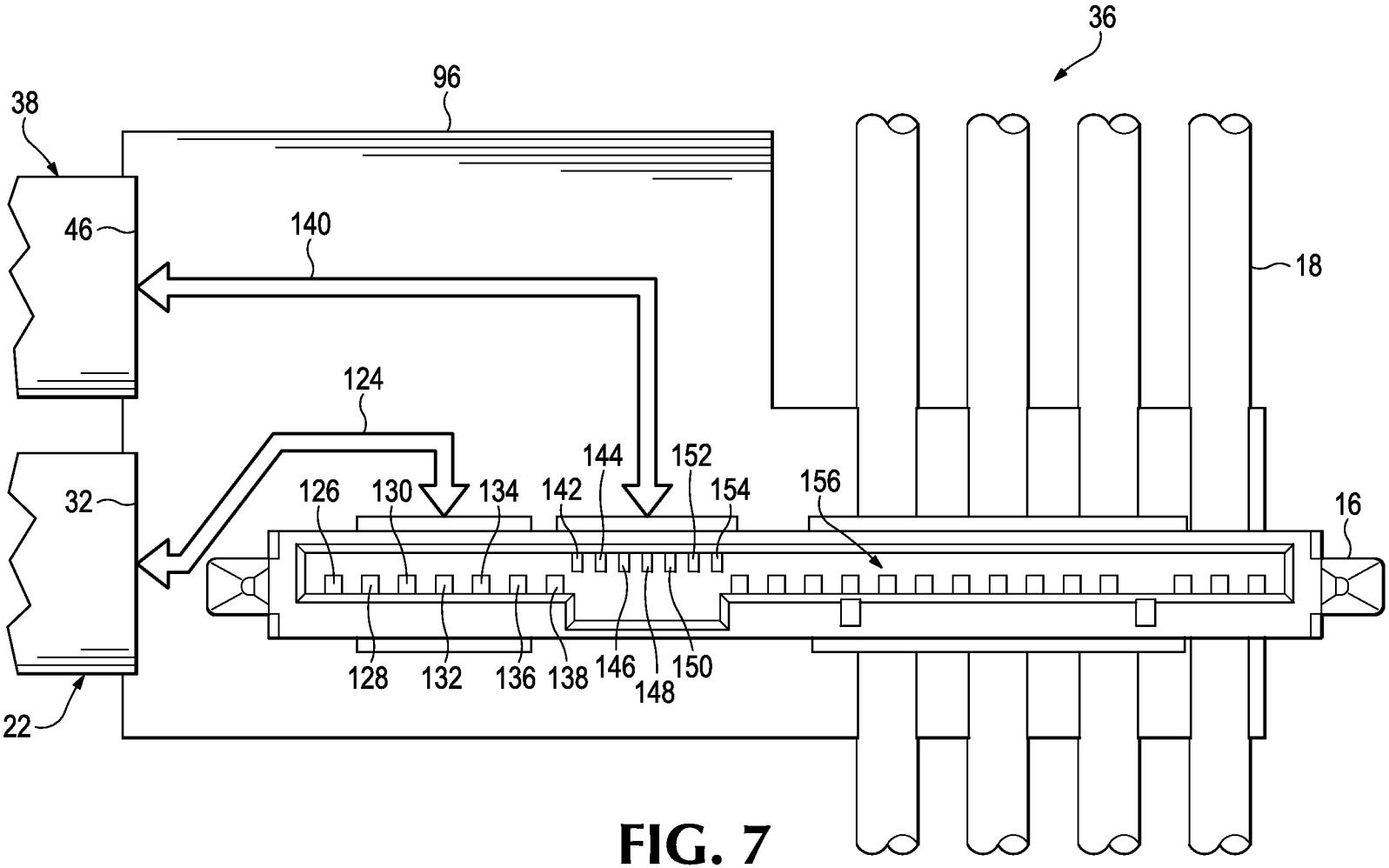
FIG. 7 is a diagram illustrating an example of signal routing of the interconnect assembly of FIG. 3.

A diagram illustrating an example of signal routing of interconnect assembly 36 is shown in FIG. 7. As can be seen in FIG. 7, a first set of signals, diagrammatically illustrated by double-headed arrow 124, may be routed via wires or traces (not shown) to and from (i.e., transceived) first cable assembly 22 to pins 126, 128, 130, 132, 134, 136, and 138 of combination connector 16. As can also be seen in FIG. 7, a second set of signals, diagrammatically illustrated by double-headed arrow 140, may be routed via wires or traces (not shown) to and from (i.e., transceived) second cable assembly 38 to pins 142, 144, 146, 148, 150, 152, and 154 of combination connector 16. As can additionally be seen in FIG. 7, power from power bus or power cables 18 is routed to the other pins of combination connector 16 at the location generally indicated by arrow 156.

Figure 8:
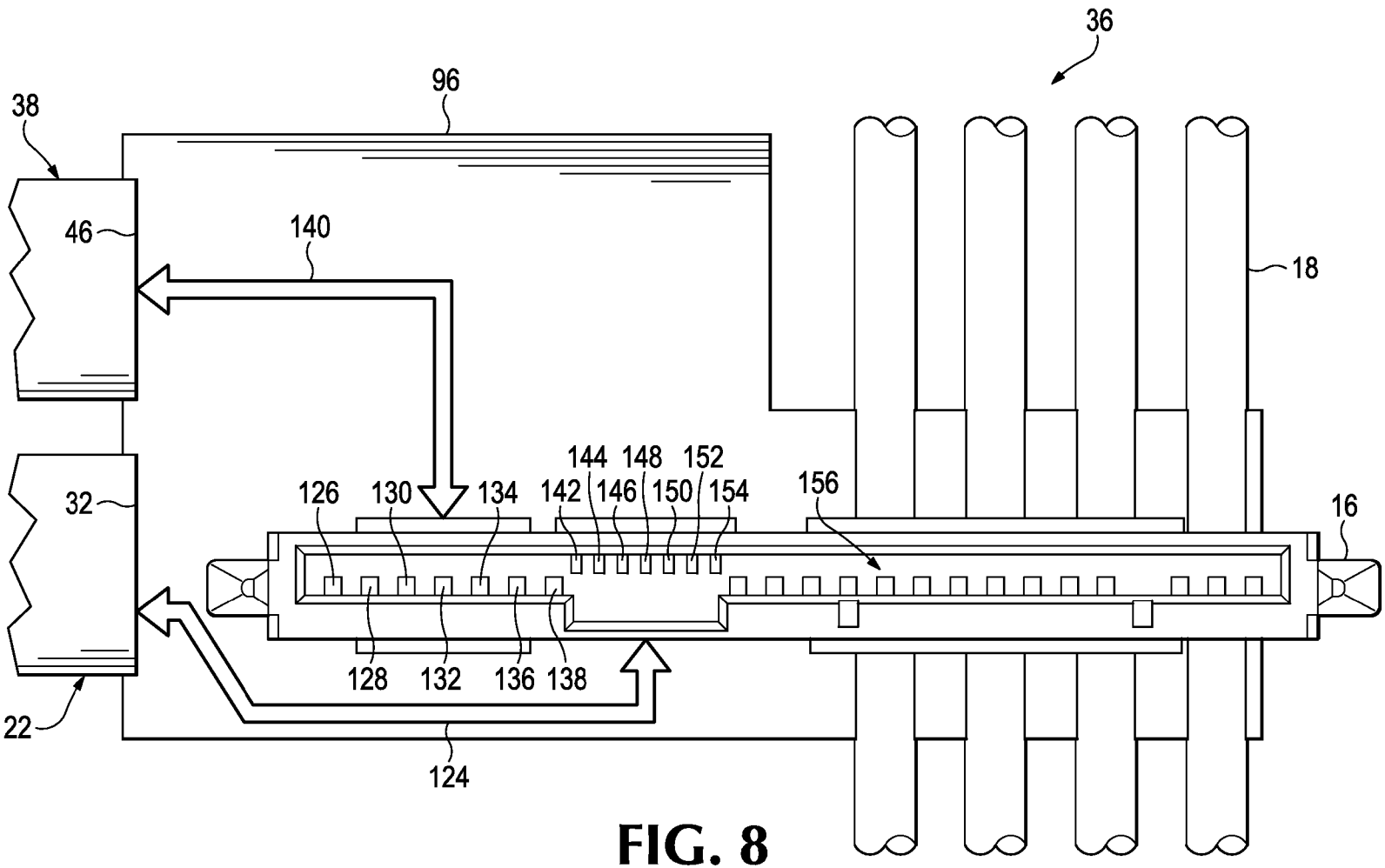
FIG. 8 is a diagram illustrating another example of signal routing of the interconnect assembly of FIG. 3.

A diagram illustrating another example of signal routing of the interconnect assembly 36 is shown in FIG. 8. As can be seen in FIG. 8, in this example, first set of signals, diagrammatically illustrated by double-headed arrow 124, may be routed via wires or traces (not shown) to and from (i.e., transceived) first cable assembly 22 to pins 142, 144, 146, 148, 150, 152, and 154 of combination connector 16. As can also be seen in FIG. 8, a second set of signals, diagrammatically illustrated by double-headed arrow 140, may be routed via wires or traces (not shown) to and from (i.e., transceived) second cable assembly 38 to pins 126, 128, 130, 132, 134, 136, and 138 of combination connector 16. As can additionally be seen in FIG. 8, power from power bus or power cables 18 is routed to the other pins of combination connector 16 at the location generally indicated by arrow 156.

Although not shown, it is to be understood that examples of interconnect assemblies 10, 20, 50, and 72, as well as others, may also route signals in a manner similar or identical to that illustrated in FIGS. 7 and 8 with respect to interconnect assembly 36. In such cases, both or either of cable assemblies 22 and 38 are replaced with first signal connector 12 and/or second signal connector 14, as applicable.

Figure 9:
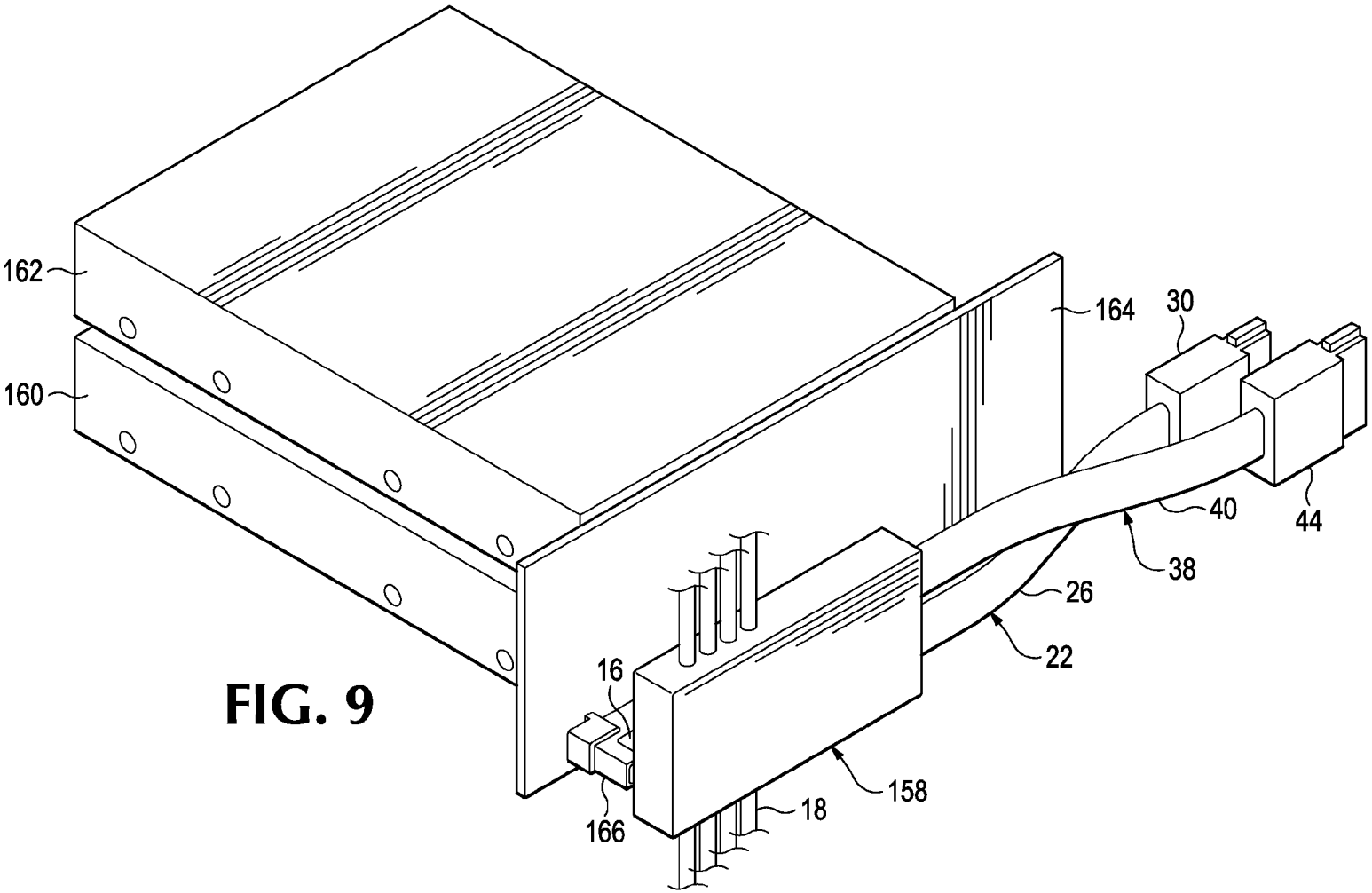
FIG. 9 is a perspective view of an example of an interconnect assembly coupled to a pair of storage devices of a storage system via a backplane.
Figure 10:
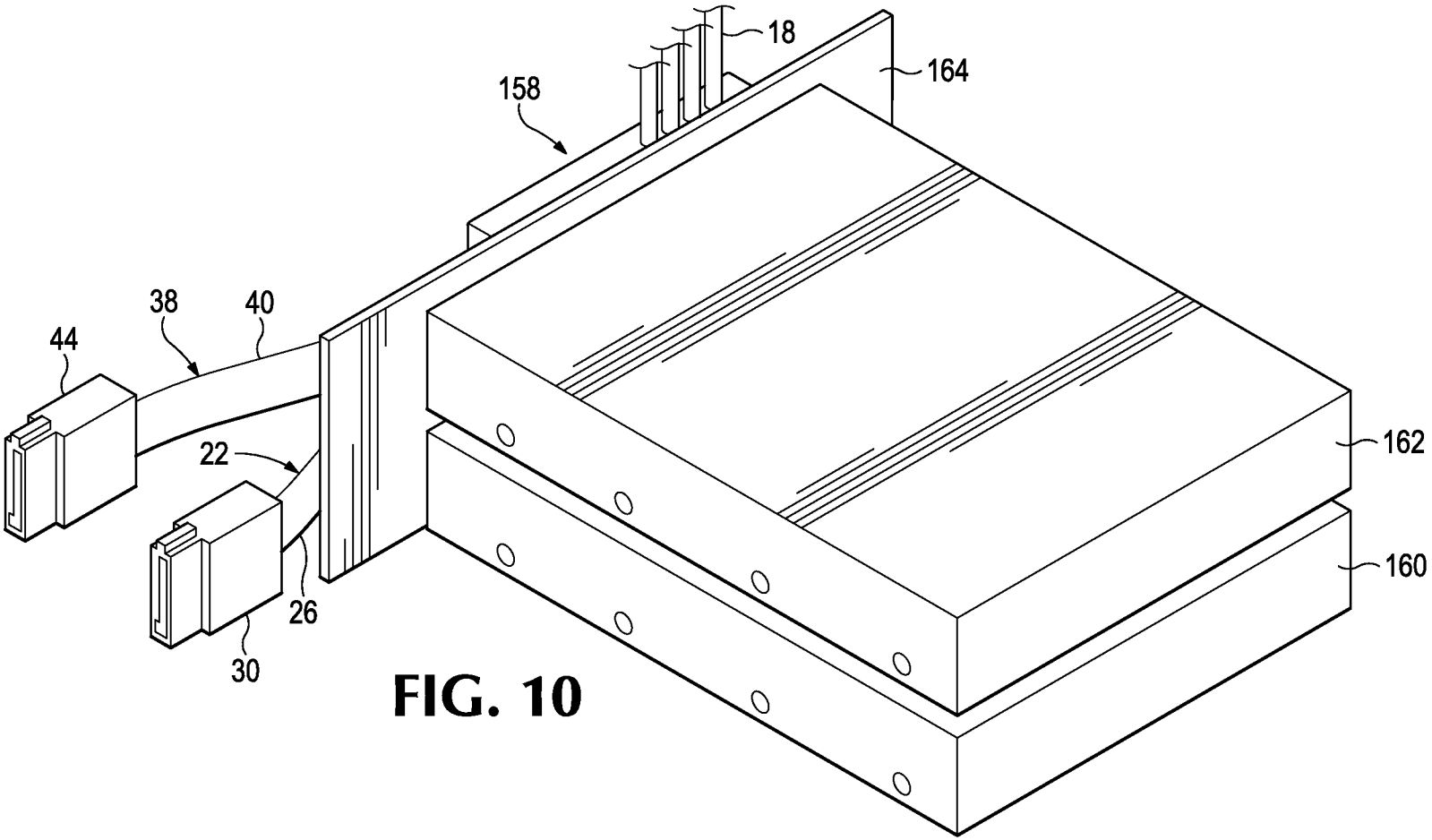
FIG. 10 is an opposite side perspective view of FIG. 9.

A perspective view of an example of an interconnect assembly 158 coupled to a first storage device 160 and a second storage device 162 of a storage system via a backplane 164 is shown in FIG. 9. An opposite side perspective view of the example of interconnect assembly 158, first storage device 160, second storage device 162, and backplane 164 is shown FIG. 10. As can be seen in FIGS. 9 and 10, in this example, interconnect assembly 158 includes above-described first cable assembly 22 that transceives a first plurality of signals and second cable assembly 38 that transceives a second plurality of signals. It is to be understood, however, that other examples of interconnect assembly 158 may include one or more of above-described first signal connector 12, second signal connector 14, first cable assembly 74 and/or second cable assembly 54 in place of either or both of respective first and second cable assemblies 22 and 38 to transceive either or both of first plurality of signals and second plurality of signals.

As can be seen in FIG. 9, interconnect assembly 158 includes above-described combination connector 16. Combination connector 16 is coupled to backplane connector 166 of backplane 164 so that the first plurality of signals are conveyed to first storage device 160 and the second plurality of signals are conveyed to second storage device 162. Coupling of backplane connector 166 and combination connector 16 also conveys power from power cables or power bus 18 to respective first and second storage devices 160 and 162.

Figure 11:
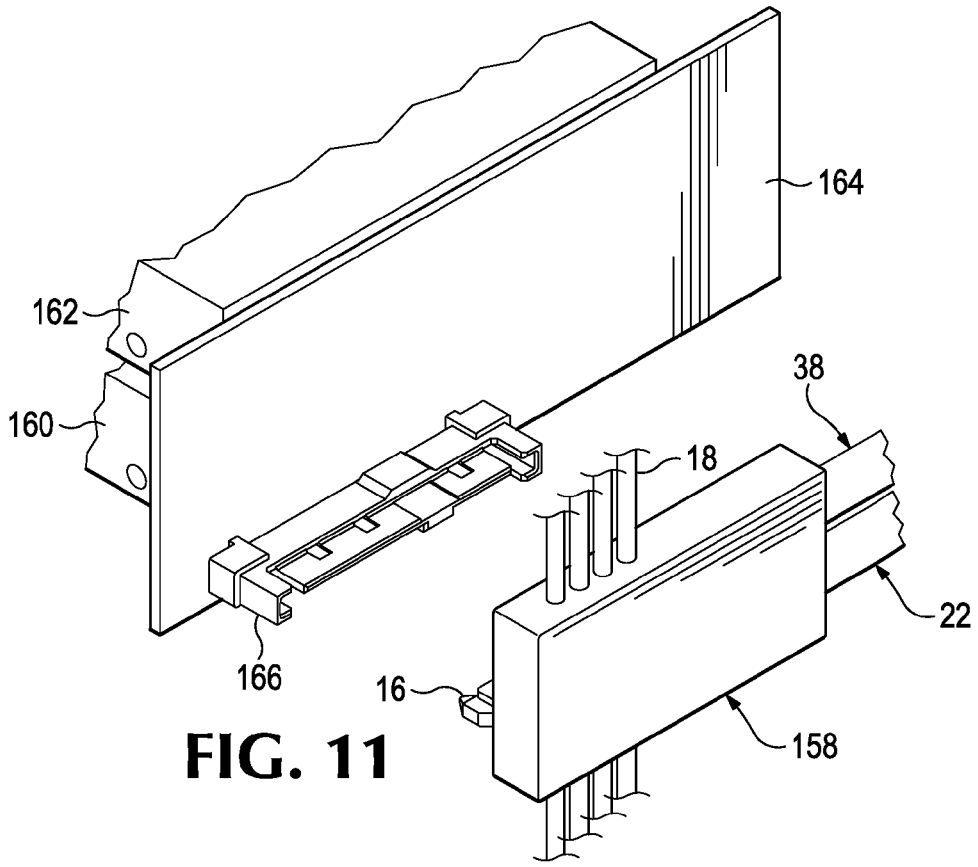
FIG. 11 is a partial exploded perspective view of FIG. 9.

FIG. 11 is a partial exploded perspective view of FIG. 9 illustrating interconnect assembly 158 uncoupled from backplane 164. That is, combination connector 16 has been uncoupled from backplane connector 166 so that the first plurality of signals are no longer conveyed to first storage device 160 and second plurality of signals are no longer conveyed to second storage device 162. Additionally, power from power cables or power bus 18 is no longer conveyed to either of respective first or second storage devices 160 and 162.

Figure 12:
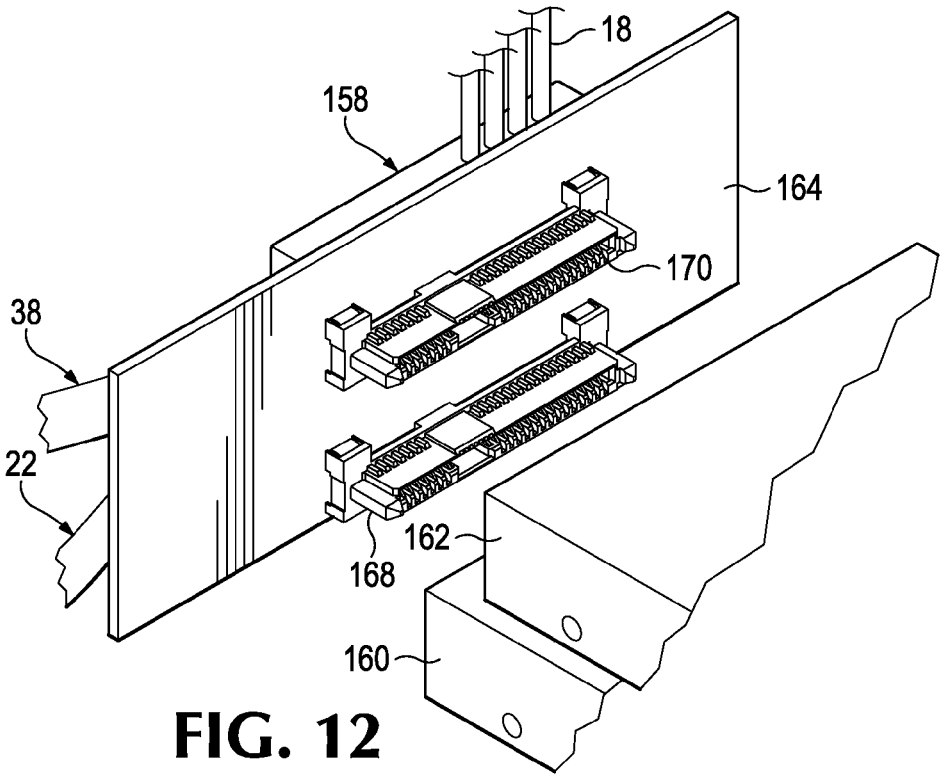
FIG. 12 is a partial exploded perspective view of FIG. 10.

FIG. 12 is a partial exploded perspective view of FIG. 10, illustrating respective first and second storage devices 160 and 162 uncoupled from backplane 164. That is, first storage device 160 has been uncoupled from first storage device connector 168 so that the first plurality of signals are no longer conveyed to first storage device 160 and second storage device 162 has been uncoupled from second storage device connector 170 so that the second plurality of signals are no longer conveyed to second storage device 162. Additionally, power from power cables or power bus 18 is no longer conveyed to either of respective first or second storage devices 160 and 162. Although both respective first and second storage devices 160 and 162 are illustrated as being uncoupled from respective first and second storage device connectors 168 and 170, it is to be understood that interconnect assembly 158 may be utilized to supply signals and power to only one of either first storage device 160 or second storage device 162, if coupled to either first storage device connector 168 or second storage device connector 170.

Figure 13:
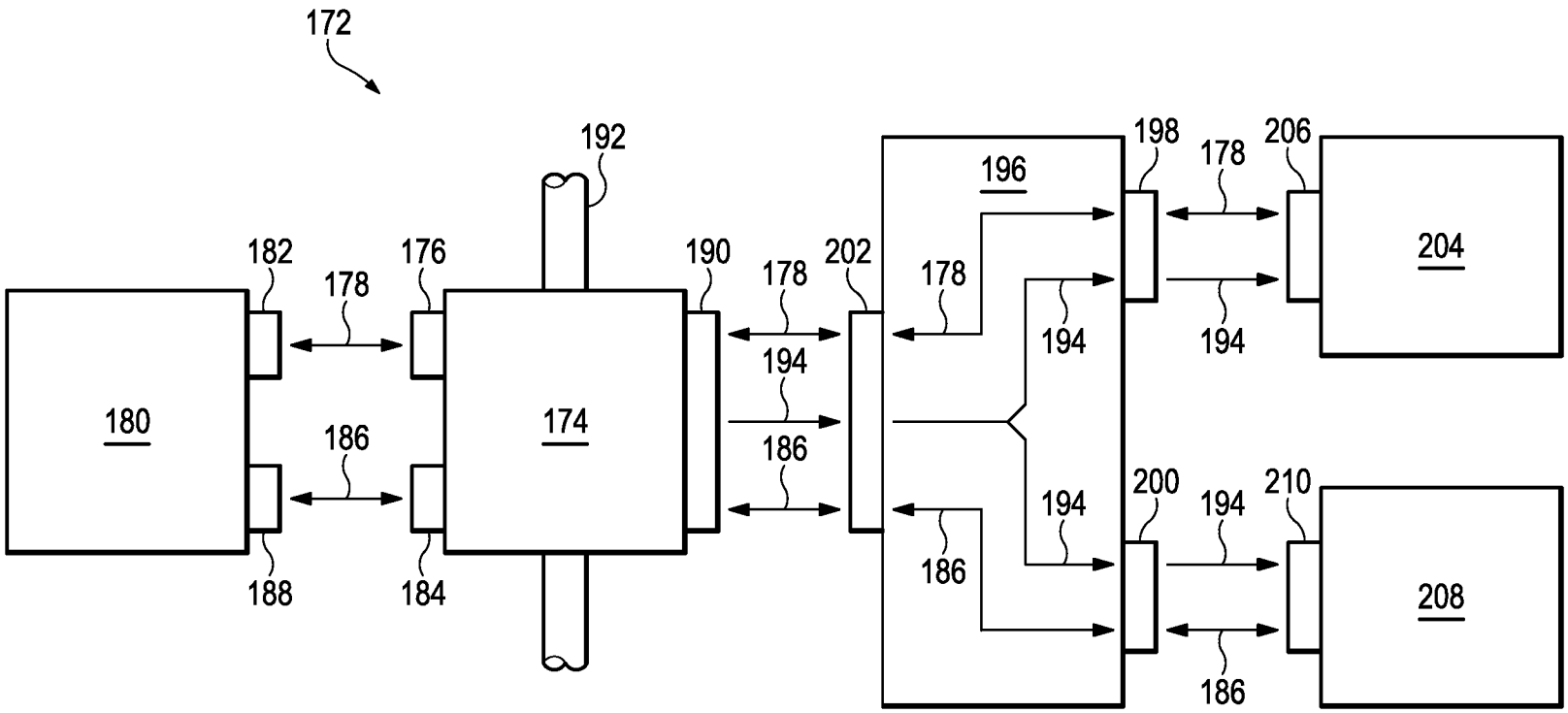
FIG. 13 is an example of a block diagram of a system utilizing an interconnect assembly.

An example of a block diagram of a system 172 utilizing an interconnect assembly 174 is shown in FIG. 13. As can be seen in FIG. 13, interconnect assembly 174 includes a first signal connector 176 that transceives a first plurality of signals 178 to and from a host controller 180 coupled to first signal connector 176 via connector 182 and a second signal connector 184 that transceives a second plurality of signals 186 to and from host controller 180 coupled to second signal connector 184 via connector 188. Interconnect assembly 174 also includes a combination connector 190 coupled to first plurality of signals 178 and second plurality of signals 186. Interconnect assembly 174 additionally includes a power bus or plurality of power cables 192 coupled to combination connector 190 to supply power to combination connector 190.

As can also be seen in FIG. 13, system 172 also includes a backplane 196 that includes a first storage device connector 198 and a second storage device connector 200. Backplane 196 also includes a backplane connector 202 coupled to combination connector 190 to convey first plurality of signals 178 to and from first storage device 204 coupled to first storage device connector 198 via connector 206 and to convey second plurality of signals 186 to and from second storage device 208 coupled to second storage device connector 200 via connector 210. As can additionally be seen in FIG. 13, combination connector 190 also conveys power 194 to both first storage device 204 and second storage device 208.

Figure 14:
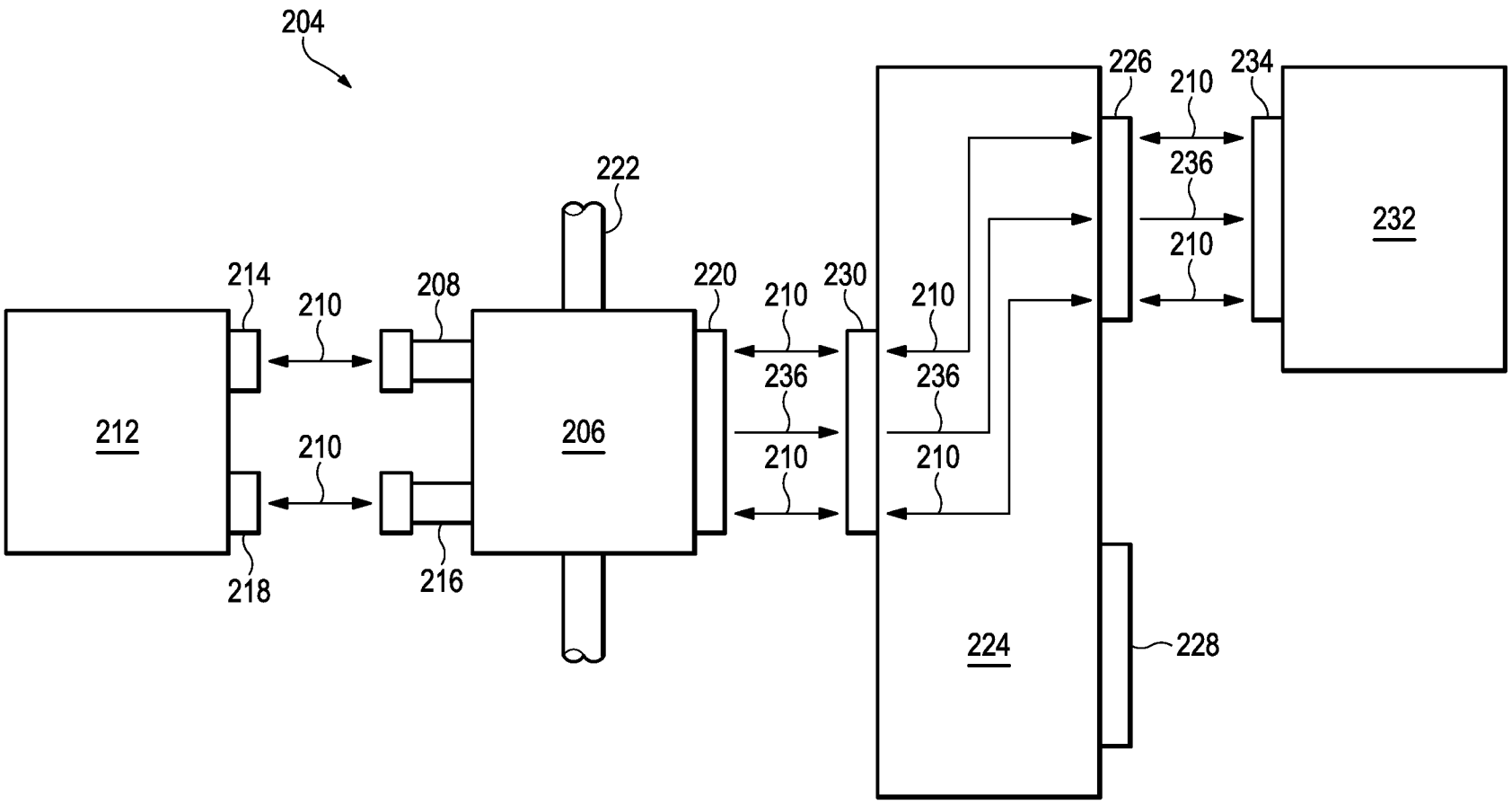
FIG. 14 is an example of a block diagram of another system utilizing an interconnect assembly.

An example of a block diagram of another system 204 utilizing an interconnect assembly 206 is shown in FIG. 14. As can be seen in FIG. 14, interconnect assembly 206 includes a first cable assembly 208 that transceives a first plurality of signals 210 to and from a host controller 212 coupled to first cable assembly 208 via connector 214 and a second cable assembly 216 that also transceives first plurality of signals 210 to and from host controller 212 coupled to second cable assembly 216 via connector 218. Interconnect assembly 206 also includes a combination connector 220 coupled to first plurality of signals 210 and a power bus or plurality of power cables 222 coupled to combination connector 220 to supply power to combination connector 220.

As can also be seen in FIG. 14, system 204 also includes a backplane 224 that includes a first storage device connector 226 and a second storage device connector 228. Backplane 224 also includes a backplane connector 230 coupled to combination connector 220 to convey first plurality of signals 210 to and from first storage device 232 coupled to first storage device connector 226 via connector 234. As can additionally be seen in FIG. 14, combination connector 220 also conveys power 236 to first storage device 232.

The example of system 204 illustrated in FIG. 14 provides redundancy for the transmission and receipt of first plurality of signals 210 to and from host controller 212 and first storage device 232 via interconnect assembly 206. This allows the illustrated interconnect assembly to be utilized in applications and environments where high reliability transfers with low data loss is needed.

Figure 15:
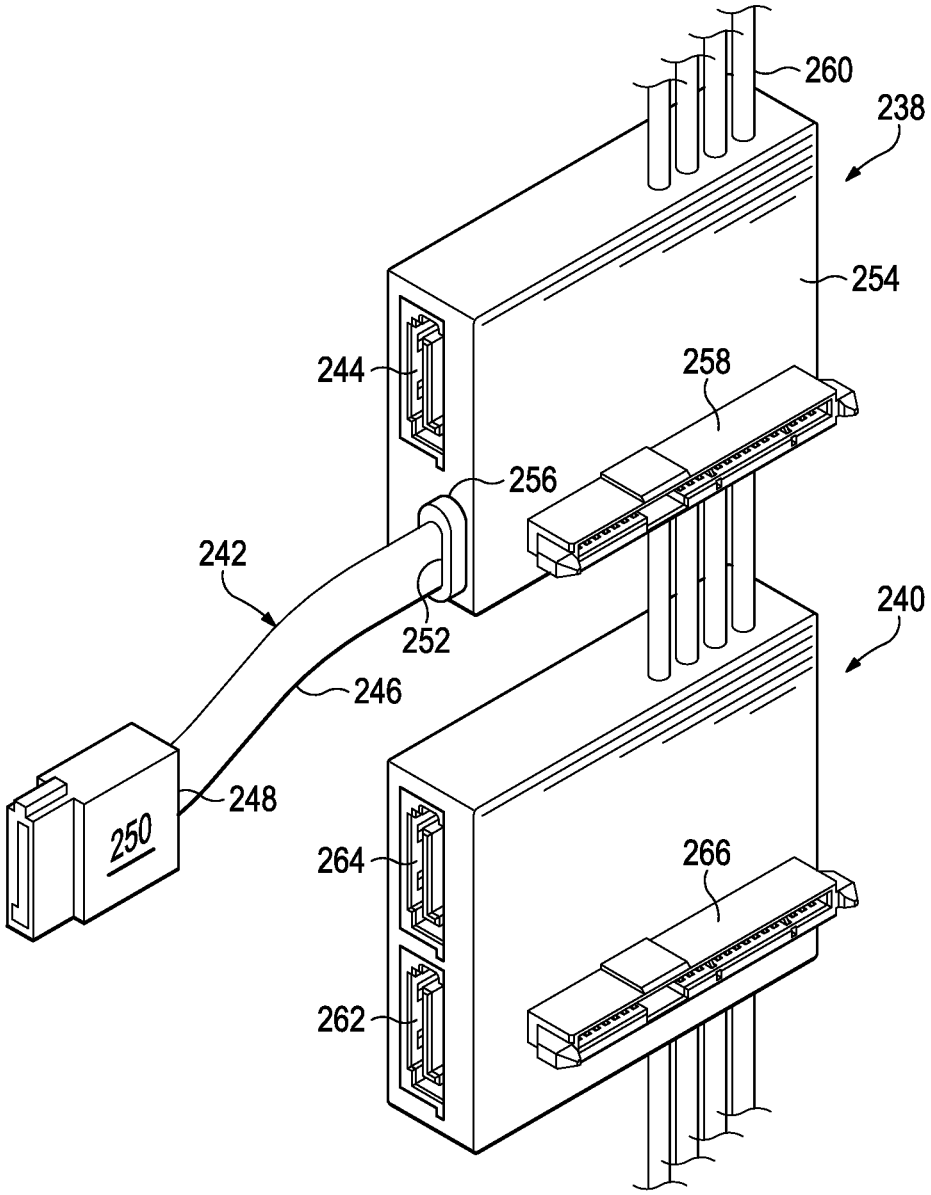
FIG. 15 is a perspective view of an example of daisy-chaining or ganging of interconnect assemblies.

A perspective view of an example of daisy-chaining or ganging of interconnect assemblies 238 and 240 is shown in FIG. 15. As can be seen in FIG. 15, in this example, interconnect assembly 238 includes a first cable assembly 242 and a second signal connector 244. As can be seen in FIG. 15, first cable assembly 242 includes a flexible sleeve 246 that terminates on one end 248 in a plug 250 and on another end 252 that is coupled to housing 254. As can also be seen in FIG. 15, first cable assembly 242 includes a strain relief 256 coupled to housing 254.

Interconnect assembly 238 additionally includes combination connector 258 coupled to first cable assembly 242 and to second signal connector 244. Interconnect assembly 238 further includes power bus or plurality of power cables 260 coupled to combination connector 258 to supply power to combination connector 258.

As can also be seen in FIG. 15, interconnect assembly 240 includes a first signal connector 262 and a second signal connector 264. Interconnect assembly 240 additionally includes a combination connector 266 coupled to first signal connector 262 and second signal connector 264. Power bus or plurality of power cables 260 are also coupled to combination connector 266 to supply power to combination connector 266 as well. In this manner or way, any number of additional interconnect assemblies (of the same or different design as interconnect assemblies 238 and 240) may be daisy-chained or ganged with interconnect assemblies 238 and 240. This daisy-chaining or ganging provides flexibility in configuring a variety of different types of arrangements and systems to meet particular consumer needs.

Figure 16:
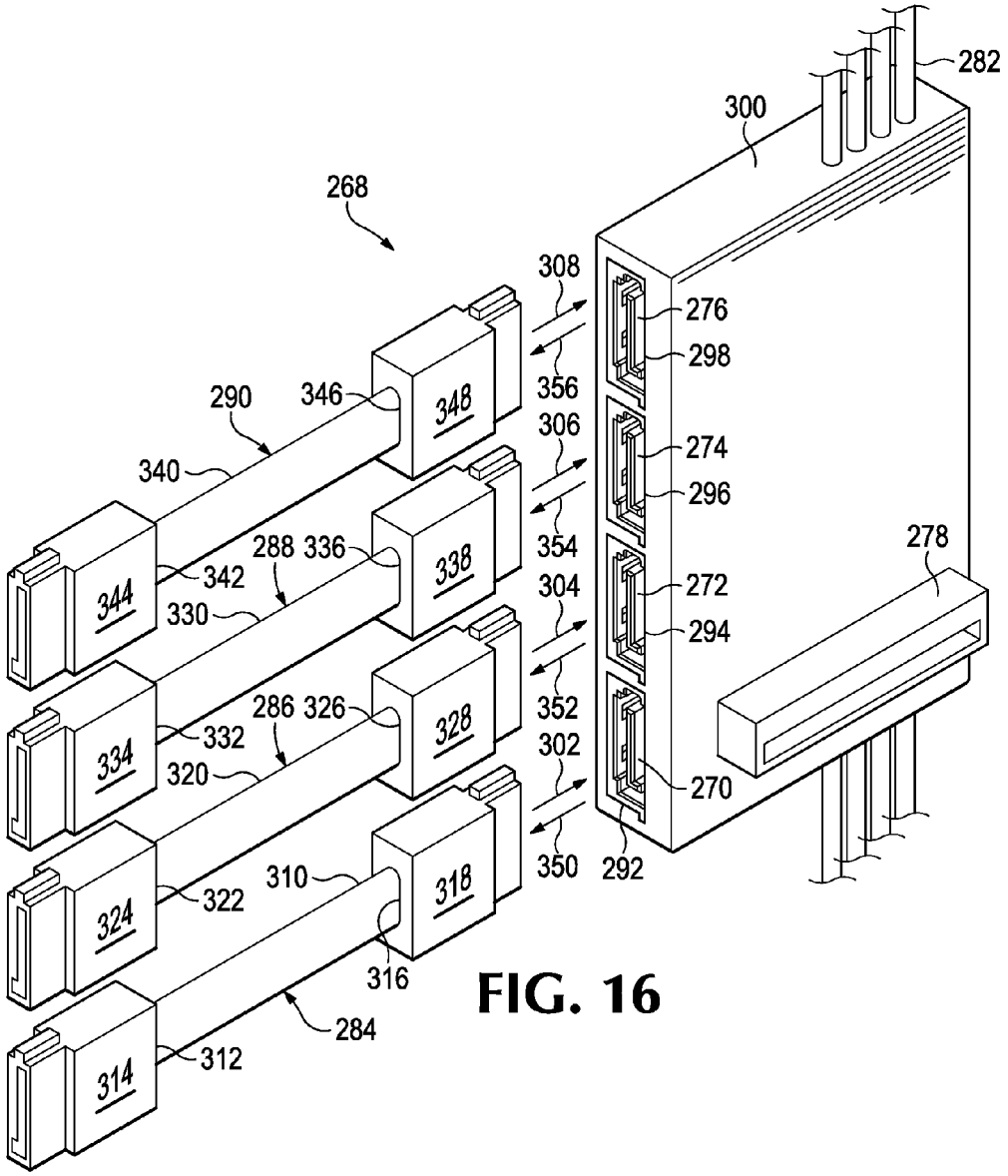
FIG. 16 is a perspective view of still yet a further example of an interconnect assembly.

A perspective view of still yet a further example of an interconnect assembly 268 is shown in FIG. 16. As can be seen in FIG. 16, interconnect assembly 268 includes respective first, second, third, and fourth signal connectors 270, 272, 274, and 276. Interconnect assembly 268 additionally includes a custom combination connector 278 coupled to first signal connector 270, second signal connector 272, third signal connector 274, and fourth signal connector 276. Interconnect assembly 268 additionally includes a power bus or plurality of power cables 282 coupled to custom combination connector 278 to supply power to custom combination connector 278.

As can also be seen in FIG. 16, interconnect assembly 268 includes respective first, second, third and fourth cable assemblies 284, 286, 288, and 290 each of which is couplable to respective first, second, third, and fourth signal connectors 270, 272, 274, and 276 by insertion into respective sockets 292, 294, 296, and 298 defined by housing 300 in the direction indicated by respective arrows 302, 304, 306, and 308. First cable assembly 284 includes a flexible sleeve 310 that terminates on one end 312 in a plug 314 and on another end 316 in a plug 318. Second cable assembly 286 includes a flexible sleeve 320 that terminates on one end 322 in a plug 324 and on another end 326 in a plug 328. Third cable assembly 288 includes a flexible sleeve 330 that terminates on one end 332 in a plug 334 and on another end 336 in a plug 338. Fourth cable assembly 290 includes a flexible sleeve 340 that terminates on one end 342 in a plug 344 and on another end 346 in a plug 348.

Plugs 318, 328, 338, and 348 are each designed to matingly engage with respective first, second, third and fourth signal connectors 270, 272, 274, and 276 to couple respective first, second, third, and fourth cable assemblies 284, 286, 288, and 290 to respective first, second, third, and fourth signal connectors 270, 272, 274, and 276. First cable assembly 284 may be uncoupled from first signal connector 270 by removing plug 318 from socket 292 in the direction indicated by arrow 350. Second cable assembly 286 may be uncoupled from second signal connector 272 by removing plug 328 from socket 294 in the direction indicated by arrow 352. Third cable assembly 288 may be uncoupled from third signal connector 274 by removing plug 338 from socket 296 in the direction indicated by arrow 354. Fourth cable assembly 290 may be uncoupled from fourth signal connector 276 by removing plug 348 from socket 298 in the direction indicated by arrow 356.

In the example of interconnect assembly 268 shown in FIG. 16, plugs 314, 318, 324, 328, 334, 338, 344, and 348 each include a Serial AT Attachment (SATA) connector. It is to also be understood, however, that in other examples of interconnect assembly 268, one or more of plugs 314, 318, 324, 328, 334, 338, 344, and 348 may be a different type of connector.

Figure 17:
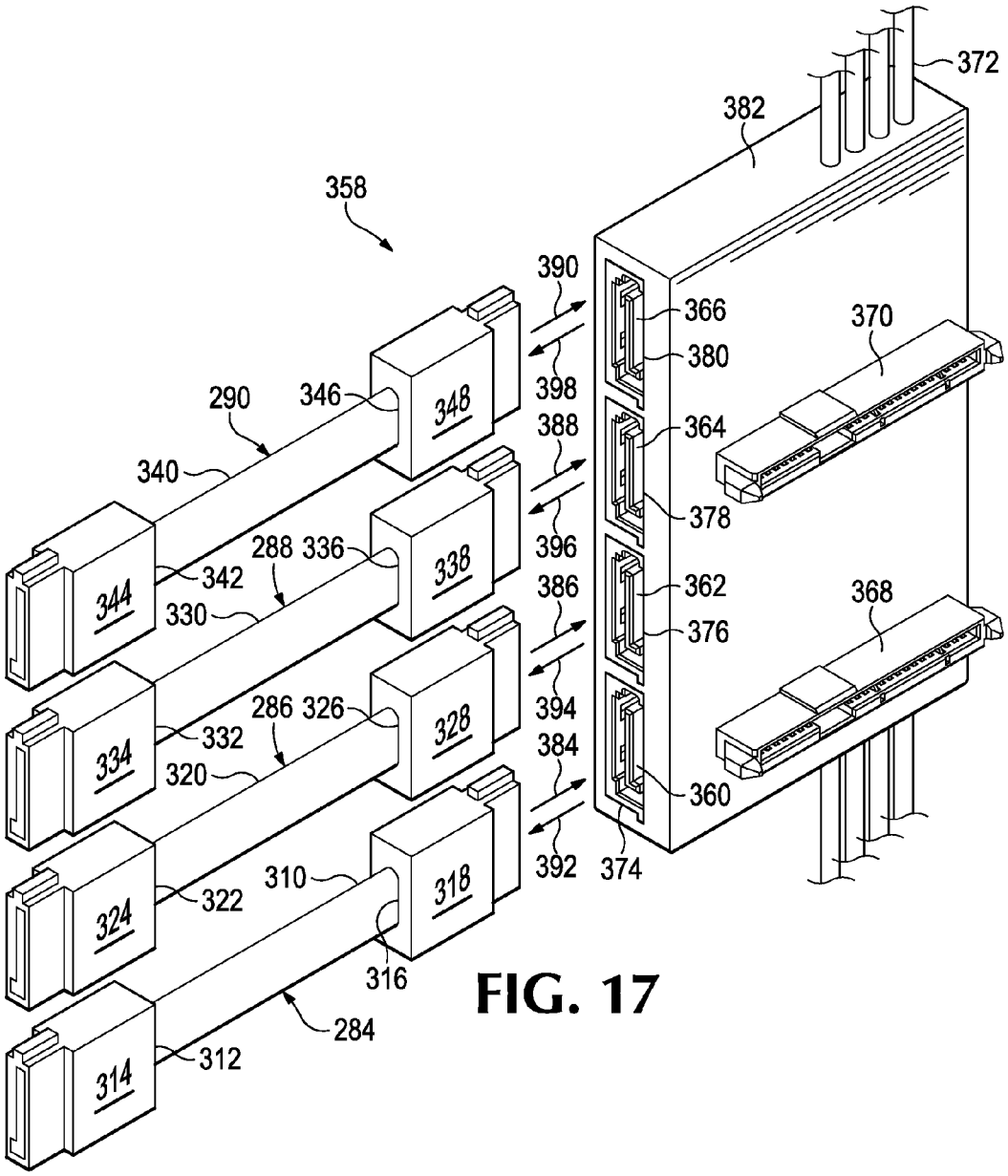
FIG. 17 is a perspective view of still yet a further additional example of an interconnect assembly.

A perspective view of still yet a further additional example of an interconnect assembly 358 is shown in FIG. 17. As can be seen in FIG. 17, interconnect assembly 358 includes respective first, second, third, and fourth signal connectors 360, 362, 364, and 366. Interconnect assembly 358 additionally includes a first combination connector 368 coupled to first signal connector 360 and second signal connector 362 and a second combination connector 370 coupled to third signal connector 364, and fourth signal connector 366. Interconnect assembly 358 additionally includes a power bus or plurality of power cables 372 coupled to both first combination connector 368 and second combination connector 370 to supply power to first combination connector 368 and second combination connector 370.

As can also be seen in FIG. 17, interconnect assembly 358 includes above-described respective first, second, third and fourth cable assemblies 284, 286, 288, and 290 each of which is couplable to respective first, second, third, and fourth signal connectors 360, 362, 364, and 366 by insertion into respective sockets 374, 376, 378, and 380 defined by housing 382 in the direction indicated by respective arrows 384, 386, 388, and 390.

Plugs 318, 328, 338, and 348 are each designed to matingly engage with respective first, second, third and fourth signal connectors 360, 362, 364, and 366 to couple respective first, second, third, and fourth cable assemblies 284, 286, 288, and 290 to respective first, second, third, and fourth signal connectors 360, 362, 364, and 366. First cable assembly 284 may be uncoupled from first signal connector 360 by removing plug 318 from socket 374 in the direction indicated by arrow 392. Second cable assembly 286 may be uncoupled from second signal connector 362 by removing plug 328 from socket 376 in the direction indicated by arrow 394. Third cable assembly 288 may be uncoupled from third signal connector 364 by removing plug 338 from socket 378 in the direction indicated by arrow 396. Fourth cable assembly 290 may be uncoupled from fourth signal connector 366 by removing plug 348 from socket 380 in the direction indicated by arrow 398.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, although two storage devices 160 and 162 are illustrated in FIGS. 9-12, it is to be understood that in one or more examples of other interconnect assemblies, a greater number of storage devices may be utilized. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. An interconnect assembly, comprising:

a housing;

multiple signal connectors provided on the housing, including a first signal connector and a second signal connector, wherein each of the multiple signal connectors includes a plurality of signal elements;

a power bus to receive power from an external source, the power bus including one or more bus elements; and a combination connector provided on the housing and having a plurality of connection elements, wherein the plurality of connection elements includes a first set of connection elements which route within the housing to the plurality of signal elements of the first signal connector, a second set of connection elements which route within the housing to the plurality of signal elements of the second signal connector, and a third set of connection elements which route within the housing to the one or more bus elements of the power bus, wherein the combination connector is to isolate the power bus from the multiple signal connectors so that power from the power bus does not reach the multiple signal connectors.

2. The interconnect assembly of claim 1, further comprising a printed circuit board provided within the housing, wherein the printed circuit board includes a combination of trace elements and/or wires to route (i) the first set of connection elements to the plurality of signal elements of the first signal connector, and (ii) the second set of connection elements to the plurality of signal elements of the second signal connector.

3. The interconnect assembly of claim 2, wherein the printed circuit board includes one or more elements, separate from the combination of trace elements and/or wires, to route the one or more bus elements of the power bus to the third set of connection elements.

4. The interconnect assembly of claim 2, wherein the combination connector is connected to the printed circuit board.

5. The interconnect assembly of claim 1, wherein the connection elements of the combination connector include pins.

6. The interconnect assembly of claim 1, wherein the multiple signal connectors are provided on a first side of the housing, and the combination connector is provided on a second side of the housing.

7. The interconnect assembly of claim 1, wherein the power bus directly connects to the third set of connection elements of the combination connector.

8. The interconnect assembly of claim 1, wherein the power bus receives power from the external source on a third side of the housing.

9. The interconnect assembly of claim 1, wherein the multiple signal connectors includes a third signal connector and a fourth signal connector; and wherein the interconnect assembly comprises:

second combination connector provided on the housing and having a second plurality of connection elements, wherein the second plurality of connection elements includes a third set of connection elements which route within the housing to the plurality of signal elements of the third signal connector, a fourth set of connection elements which route within the housing to the plurality of signal elements of the fourth signal connector, and a fifth set of connection elements which route within the housing to the one or more bus elements of the power bus.

10. A connector system comprising:

a housing;

multiple signal connectors provided on the housing, including a first signal connector and a second signal connector, wherein each of the multiple signal connectors includes a plurality of signal elements;

a power bus to receive power from an external source, the power bus including one or more bus elements;

a combination connector provided on the housing and having a plurality of connection elements, wherein the plurality of connection elements includes a first set of connection elements which route within the housing to the plurality of signal elements of the first signal connector, a second set of connection elements which route within the housing to the plurality of signal elements of the second signal connector, and a third set of connection elements which route within the housing to the one or more bus elements of the power bus, wherein the combination connector is to isolate the power bus from the multiple signal connectors so that power from the power bus does not reach the multiple signal connectors; and a backplane assembly including a backplane, a first storage device connector and a backplane connector, wherein the backplane connector connects to the combination connector and to the first storage device connector, and the first storage device connector is positioned to connect to a first storage device.

11. The system of claim 10, wherein each of the multiple signal connectors is coupleable and decoupleable to a corresponding cable assembly, and each of the multiple signal connectors is coupleable and decoupleable to the corresponding signal connector along a first direction that extends with the backplane.

12. The system of claim 10, further comprising a host controller coupled to one of the multiple signal connectors to transceive signals to at least the first storage device when the first storage device is connected to the first storage device connector.

13. The system of claim 10, wherein the backplane assembly includes a second storage device connector, and wherein the backplane connector connects to the second storage device connector, and the second storage device connector is positioned to connect to a second storage device.

14. The system of claim 13, further comprising the first storage device coupled to the first storage device connector, and the second storage device coupled to the second storage device connector.

15. The system of claim 10, further comprising a printed circuit board provided within the housing, wherein the printed circuit board includes a combination of trace elements and/or wires to route (i) the first set of connection elements to the plurality of signal elements of the first signal connector, and (ii) the second set of connection elements to the plurality of signal elements of the second signal connector.

16. The system of claim 15, wherein the printed circuit board includes one or more elements, separate from the combination of trace elements and/or wires, to route the one or more bus elements of the power bus to the third set of connection elements.

17. The system of claim 10, wherein the multiple signal connectors are provided on a first side of the housing, and the combination connector is provided on a second side of the housing to connect to the backplane connector.

18. The system of claim 10, wherein the multiple signal connectors are provided on a first side of the housing, and the combination connector is provided on a second side of the housing.

19. The system of claim 10, wherein the power bus receives power from the external source on a third side of the housing.

* * * * *